US007976111B2

(12) United States Patent
Sans Rovira et al.

(10) Patent No.: US 7,976,111 B2
(45) Date of Patent: Jul. 12, 2011

(54) SUPPORT STRUCTURE FOR A CLOTHES WASHING MACHINE

(75) Inventors: Ramón Sans Rovira, Barcelona (ES); Ignasi Riera Curcoll, Barcelona (ES)

(73) Assignee: Girbau, S.A., Barcelona (ES)

( * ) Notice: Subject to any disclaimer, the term of this patent is extended or adjusted under 35 U.S.C. 154(b) by 665 days.

(21) Appl. No.: 11/883,608

(22) PCT Filed: Feb. 2, 2005

(86) PCT No.: PCT/ES2005/000043

§ 371 (c)(1),
(2), (4) Date: May 19, 2008

(87) PCT Pub. No.: WO2006/082256

PCT Pub. Date: Aug. 10, 2006

(65) Prior Publication Data

US 2009/0121594 A1 May 14, 2009

(51) Int. Cl.
*A47B 77/06* (2006.01)

(52) U.S. Cl. ..... 312/228; 248/678

(58) Field of Classification Search ..... 312/228; 248/346.03, 638, 676–678, 562, 636; 68/24, 68/58, 140

See application file for complete search history.

(56) References Cited

U.S. PATENT DOCUMENTS 2,300,690 A * 11/1942 Neuman ..... 68/24
2,352,363 A * 6/1944 Bassett, Jr. ..... 68/140
2,414,154 A * 1/1947 Leef ..... 68/140
2,912,194 A 11/1959 Hutterer
2,963,892 A * 12/1960 Edwards ..... 68/140
2,990,706 A * 7/1961 Bochan ..... 68/24
3,197,983 A * 8/1965 Ilmer ..... 68/140
3,436,934 A * 4/1969 Stilwell, Jr. ..... 68/140
3,580,014 A * 5/1971 Mazza ..... 68/23.1
4,109,493 A * 8/1978 Hugenbruch ..... 68/140
5,211,038 A * 5/1993 Valent ..... 68/23.2
5,711,171 A * 1/1998 Uhlin ..... 68/140
6,622,530 B1 9/2003 Sumer et al.
6,870,562 B2 * 3/2005 Johnson et al. ..... 347/262
7,168,274 B2 * 1/2007 Slutsky et al. ..... 68/24

FOREIGN PATENT DOCUMENTS

DE 1 460 876 4/1969
EP 0 577 037 A1 1/1994
EP 0 675 221 A1 10/1995

(Continued)

OTHER PUBLICATIONS

International Search Report for PCT International Application No. PCT/ES2005/000043 mailed May 20, 2005.

*Primary Examiner* — Hanh V Tran
(74) *Attorney, Agent, or Firm* — RatnerPrestia

(57) ABSTRACT

A support structure for a clothes washing machine is provided. The support structure includes a frame supporting a washing tub rigidly attached thereto, and a drum arranged inside the tub to rotate with respect to a substantially horizontal or slightly tilted axis, the frame having supports for installing a motor for driving the drum. The frame is made up of resistant elements including metallic plate elements shaped by cutting and folding, assembled and joined together by screw or deformation attachment devices, or by welding. The frame can be linked by a suspension system to a base constructed in a similar way, or the frame can be rigidly joined to the base.

25 Claims, 6 Drawing Sheets

FOREIGN PATENT DOCUMENTS

| | | | | | |
|---|---|---|---|---|---|
| ES | 341042 | | 7/1968 | | |
| ES | 360955 | | 8/1970 | | |
| ES | 2108787 | T | 1/1998 | | |
| ES | 2122773 | T | 12/1998 | | |
| ES | 2133654 | T | 9/1999 | | |
| GB | 1155774 | | 6/1969 | | |
| JP | 1270893 | | * 10/1989 | ..... | 68/140 |
| JP | 10-216393 | | 8/1998 | | |
| WO | WO 2004/097098 | A1 | 11/2004 | | |

* cited by examiner

SUPPORT STRUCTURE FOR A CLOTHES WASHING MACHINE

This application is a U.S. National Phase Application of PCT International Application No. PCT/ES2005/000043, filed Feb. 2, 2005.

TECHNICAL FIELD

This invention relates to a support structure for a clothes washing machine of the type that includes a horizontal, rotary drum inside a washing tub, and is applicable both to washing machines provided with a suspension system for the washing tub and to rigid washing machines.

STATE OF THE PRIOR ART

Washing machines for clothes are known that have a washing tub intended to contain a liquid soap, and a drum with perforated walls for containing the clothes to be washed, and which is rotationally mounted inside the washing tub and driven by an electric motor to rotate in both directions with respect to an axis that is substantially horizontal or slightly tilted with respect to a horizontal direction. Generally, this type of machine can rotate the drum at a fast speed in order to drain the clothes contained inside by spinning them. In general, there are two strategic solutions to absorbing the vibrations produced by the irregular distribution of the mass of clothes inside the drum during spinning. One solution consists in incorporating a support structure with a fixed base, resting on the floor, on which the washing tub is supported by a suspension system. Another solution consists in providing a rigid support structure, anchored to the floor, to which the washing tub is rigidly attached. This second solution requires a fairly solid floor to absorb the vibrations without causing any damage or inconvenience.

Patent EP-A-0675221, in the name of Philco Italia S.p.A., discloses a support structure for the washing tub of a washing machine of the type described above, comprising a fixed base and a cradle shape frame on which the washing tub is attached by rigid brackets, with said frame being flexibly attached to said fixed base by dampers. Said cradle shape frame is made up of large mass parts, suitable for acting as balance counterweights. Therefore, the frame is made from cast iron, cement or concrete, or has an outer plastic housing filled with a solidified compound introduced into said housing in the fluid state.

A drawback of the frame of said patent EP-A-0675221 is that the manufacturing process is expensive, because models and moulds, etc. have to be made, and it is relatively complex. The fact that the frame is an integral part is also a drawback, because it has a relatively large volume and requires a large amount of space for storage. Also, the frame is very heavy because of the said large mass parts, acting as counterweights, which are incorporated into said frame, and which hinder the frame handling, transport and installation operations, etc.

In the state of the art, a cradle type frame is also known made from a plurality of parts assembled and joined by welding. This welded frame is lighter, but it has the same drawback in that it is an integral part, in other words, it has a large volume and requires a large storage space. Also, when the material with which the parts are made requires a final coating, such as one or more coats of paint, the painting must be done after the welding because the welding operation could spoil the paint. In this case, the large volume of the integral frame hinders the painting operation and requires relatively large and expensive paint application and drying facilities.

Patent EP-A-0577037, in the name of Iar-Siltal S.p.A., describes a front loading washing machine, with a rotary drum, comprising a chassis that supports a cylindrical washing tub inside which there is mounted a rotary drum with a horizontal axis. The tub is attached to the chassis by springs or dampers and linking rods provided with brakes. On the washing tub, and all the way around it, a flexible band is mounted and attached, and projecting from the outer surface of said band, on opposite sides of the tub, there is a pair of supports for said springs and linking rods. Said flexible band is provided on its inner surface with at least two projecting ribs, which are parallel to one another, and which extend for the whole length of the band and are inserted into annular grooves along the circumference of the tub. Between the flexible band and the outer wall of the tub a support is arranged and attached, for a driving motor for the drum.

Although this flexible band of said patent EP-A-0577037 avoids incorporating a frame to support the washing tub, it has the drawback that it does not provide a very solid support base for anchoring the springs and linking rods that make up the suspension system. Also, this support base would be totally insufficient for a type of washing machine that has a rigid chassis subject to strong vibrations.

In the state of the art it is also known to use flexible bands to rigidly attach the washing tub to a cradle type frame such as those described above.

DISCLOSURE OF THE INVENTION

This invention contributes to overcoming the above drawbacks and others, by providing a support structure for a clothes washing machine, of the type comprising a base adapted for resting on the floor and a frame arranged on said base and linked thereto by linking means. Said frame includes attachment means for rigidly coupling a washing tub inside of which there is mounted a drum arranged to rotate with respect to an axis that is substantially horizontal or slightly titled in the horizontal direction, and attachment means for installing a driving motor for said drum. The support structure of this invention is characterized in that the frame is mainly made up resistant elements consisting of metal plate elements shaped by cutting and folding, assembled and linked together preferably by screw or deformation attachment devices.

The base on which the frame rests is also obtained by the same technique, in other words, with metal plate elements shaped by cutting and holding, assembled and linked together preferably by screw or deformation attachment devices.

According to one embodiment, the frame comprises a front plate element, a rear plate element and a pair or side plate elements connected at the ends thereof to said front and rear plate elements to form a substantially rectangular plate box and a bottom wall that is completely or partially open. The frame defines a cradle adapted to receive a lower area of the washing tub, and it has anchoring configurations for attaching tie-rods provided around an upper area of the washing tub and pressing it against said support surfaces. It is important to bear in mind, however, that in this invention the attachment means used for rigidly coupling the washing tub to the frame are not limited to said flexible bands, and that, for example, rigid brackets can be used, or other devices, with equivalent results.

Preferably, although not exclusively, some of said front, rear and side plate elements have flanges folded at an angle, backing on to and joined to the other front, rear and side plate elements by means of said screw attachment or deformation devices installed through respective opposite holes.

The term "screw attachment devices" used herein refers to a variety of devices including, for example, the conventional screw and nut combination, but other devices can be used, such as screws attached to threaded holes, hooks with a threaded shank attached to a nut, flange, clamps, etc. The term "deformation attachment devices" relates to a variety of devices including, for example, conventional studs or rivets, preferably cold deformed, but also, for example, staples, or tongues formed in one of the plate elements and passed through holes on the other plate element and folded, etc.

In short, any plate element attachment means is applicable in this invention. Screw attachment devices are preferable because they are clean and simple to install and they are also easy to dismantle. It is preferable to use self-locking nuts, because they withstand vibrations without loosening and other thread linked blocking devices do not need to be incorporated. However, linking the plate elements by welding also achieves the objectives of this invention, although some performance is lost, such as for example, easy dismantling and the parts cannot be painted before assembly.

The design of the plate elements also includes those two-dimensional shapes that can be obtained by a first cutting stage, such as contours, windows, notches, holes, etc., and all those three-dimensional shapes that can be obtained by a subsequent folding stage, such as flanges, folds, grooves, etc. The cutting operation can be performed, for example, by die-cutting, although laser cutting is preferable, or any other cutting device that can be computer controlled. The folding operation can be performed by a simple, conventional folding machine. In both cases, the machines are relatively simple and affordable and they do not require any large or expensive installations. Moreover, the need for expensive, specific moulds or dies for each model is avoided.

With this construction, the support structure of this invention has several advantages. First of all, the parts making up the frame or the base can be obtained using relatively simple equipment that can be easily adapted to change from one model to another. Also, the individual parts are relatively lightweight with a small volume, and therefore they can be handled, stored and transported easily. For example, once obtained, the parts can be painted, dried and stored individually with a considerable saving on space and time, and they can be assembled easily using simple tools only when it is considered necessary for production. Since they are easy to transport and store, the parts can be produced in one plant and sent later elsewhere to be assembled, even to another region or country.

Another advantage that is just as important, is that all the configurations and holes needed for anchoring, positioning and centring the plate elements, and the other associated components, are incorporated into the plate elements and have been obtained in a single, computer-controlled cutting operation, which makes the washing machine assembly easy, reliable and accurate. Also, the type of construction of the structure of this invention makes it easy to implement a modular design for the bases and the frames of the various washing machine models by using, for example, some common parts and others simply with one or more of the dimensions thereof scaled. Also, the frame and the base according to this invention are very rigid and resistant thanks to a studied framework of plate elements, each of which incorporates a combination of flat areas, possibly with windows, folds or grooves that make the plate element very lightweight and create an excellent inertia moment. The screw attachments using self-locking nuts are easy and strong, and are not loosened, for example, by vibrations.

The support structure according to this invention can be applied both to washing machines that have washing tub suspension system, and also to washing machines with a rigid structure, and to domestic and industrial formats. In the case of washing machines with a suspension system, in order to balance the inertia and absorb vibrations, it is advisable to incorporate counterweight masses on the frame, which can be stored individually and assembled when required. Also, the frame of this invention offers a very suitable configuration for installing the suspension system, which is typically made up of elastic, damping elements, in the lower part of the washing tub. In other words, on the base compression springs, for example, are arranged, on top of which there rests the frame, and dampers are linked in a hinged fashion at one end to the base and at the other end to the frame. As there are no elastic, traction elements in the top part of the washing tub, the fixed base can be limited to a quadrangle of metal sections above the floor. On the contrary, when a rigid structure system is used, the resistance, lightweight and rigidity of the frame according to this invention is advantageous, and the frame can be connected to the base using rigid elements, which can be made up, for example, of lower extensions of some of the plate elements making up the frame, or the base can be made up of arrangements of the same plate elements that form the frame.

BRIEF DESCRIPTION OF THE DRAWINGS

The above and other advantages and features will be more fully understood from the following detailed description of exemplary embodiments with reference to the annexed drawings, in which.

DETAILED DESCRIPTION OF AN EXEMPLARY EMBODIMENT

Figure 1:
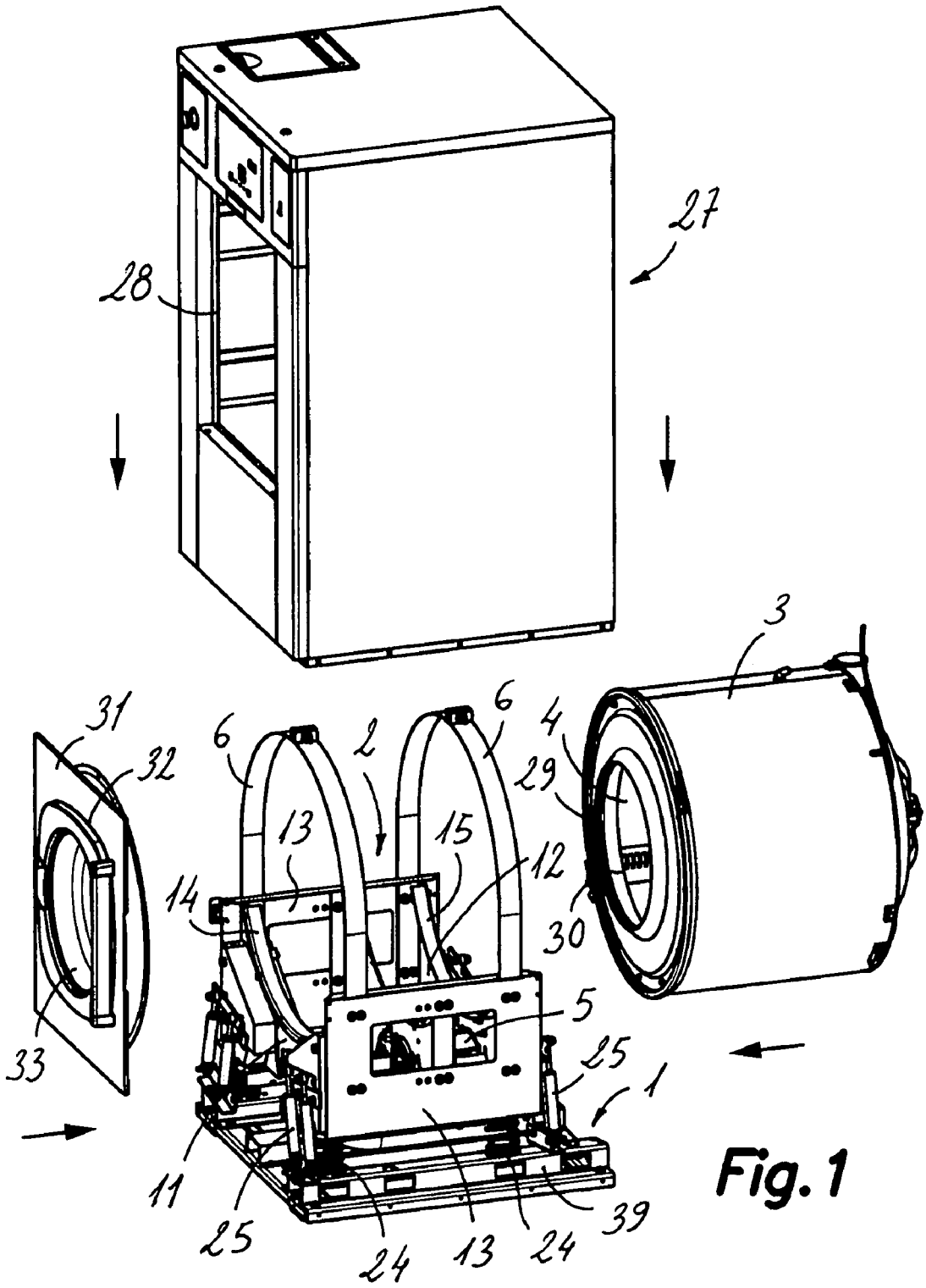
FIG. 1 is an exploded, perspective view of a clothes washing machine that incorporates a support structure according to a first embodiment of this invention.
Figure 2:
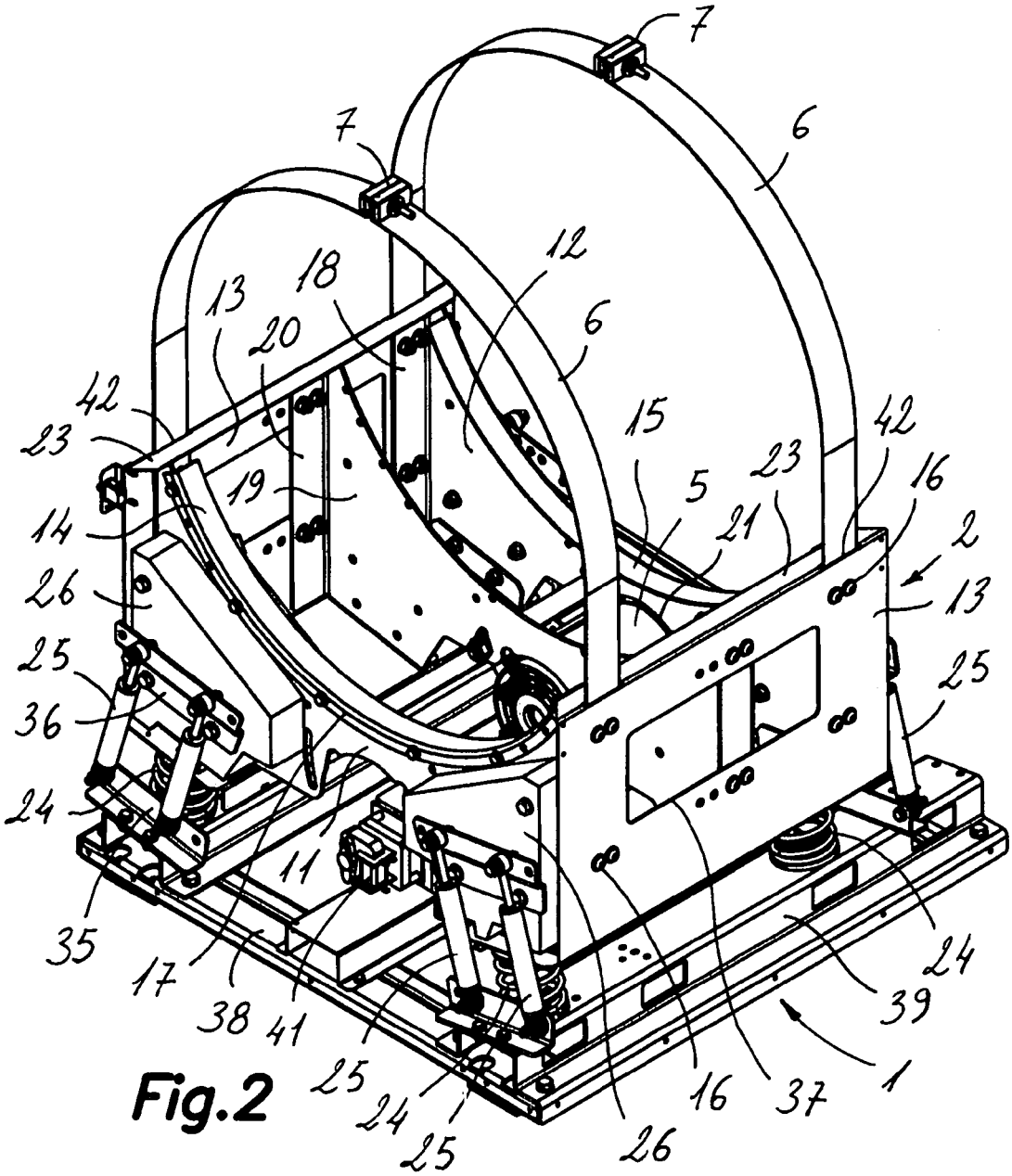
FIG. 2 is a perspective view of a base and a frame that make up the support structure of FIG. 1.
Figure 3:
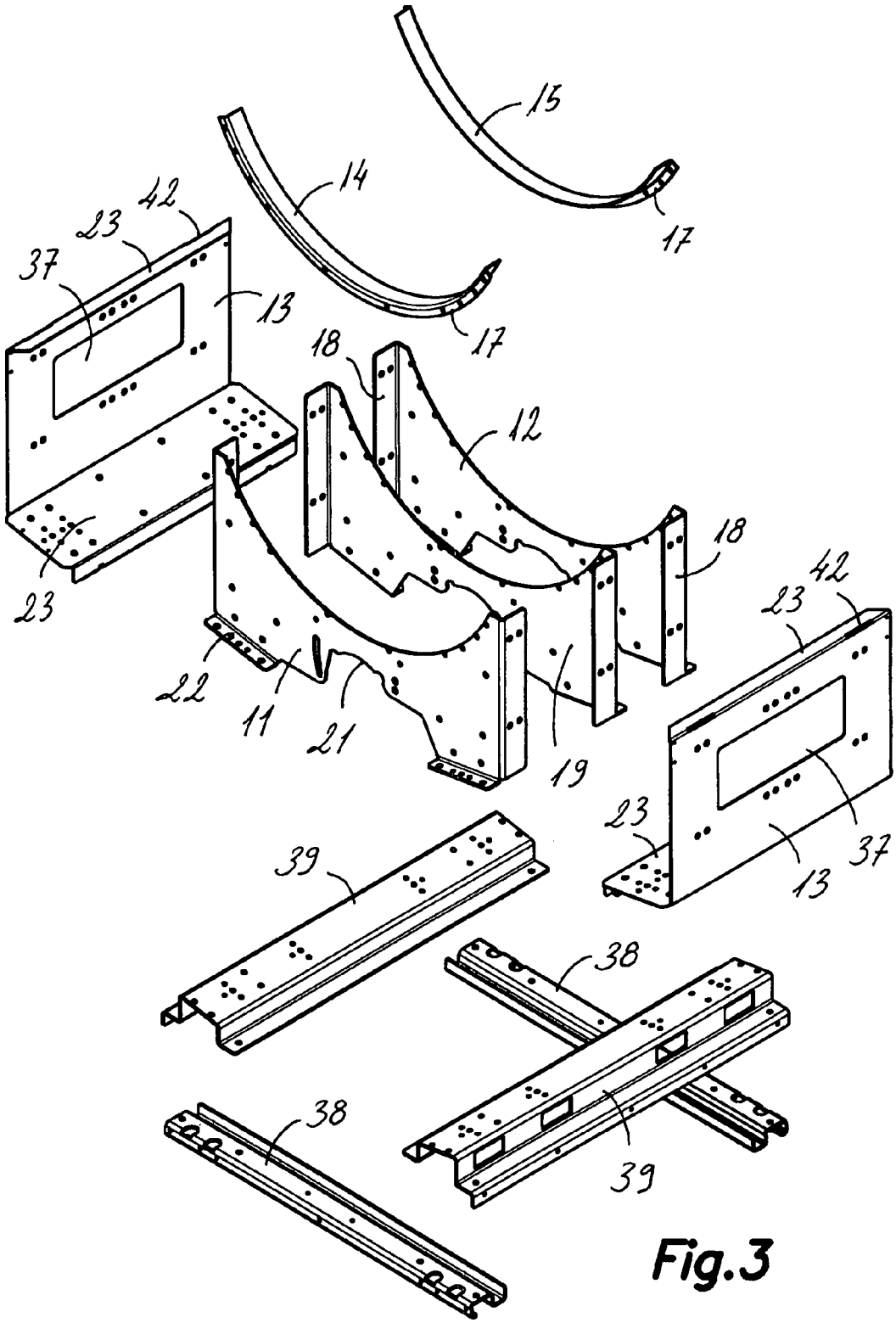
FIG. 3 is an exploded perspective view of the frame and the base in FIGS. 1 and 2.
Figure 4:
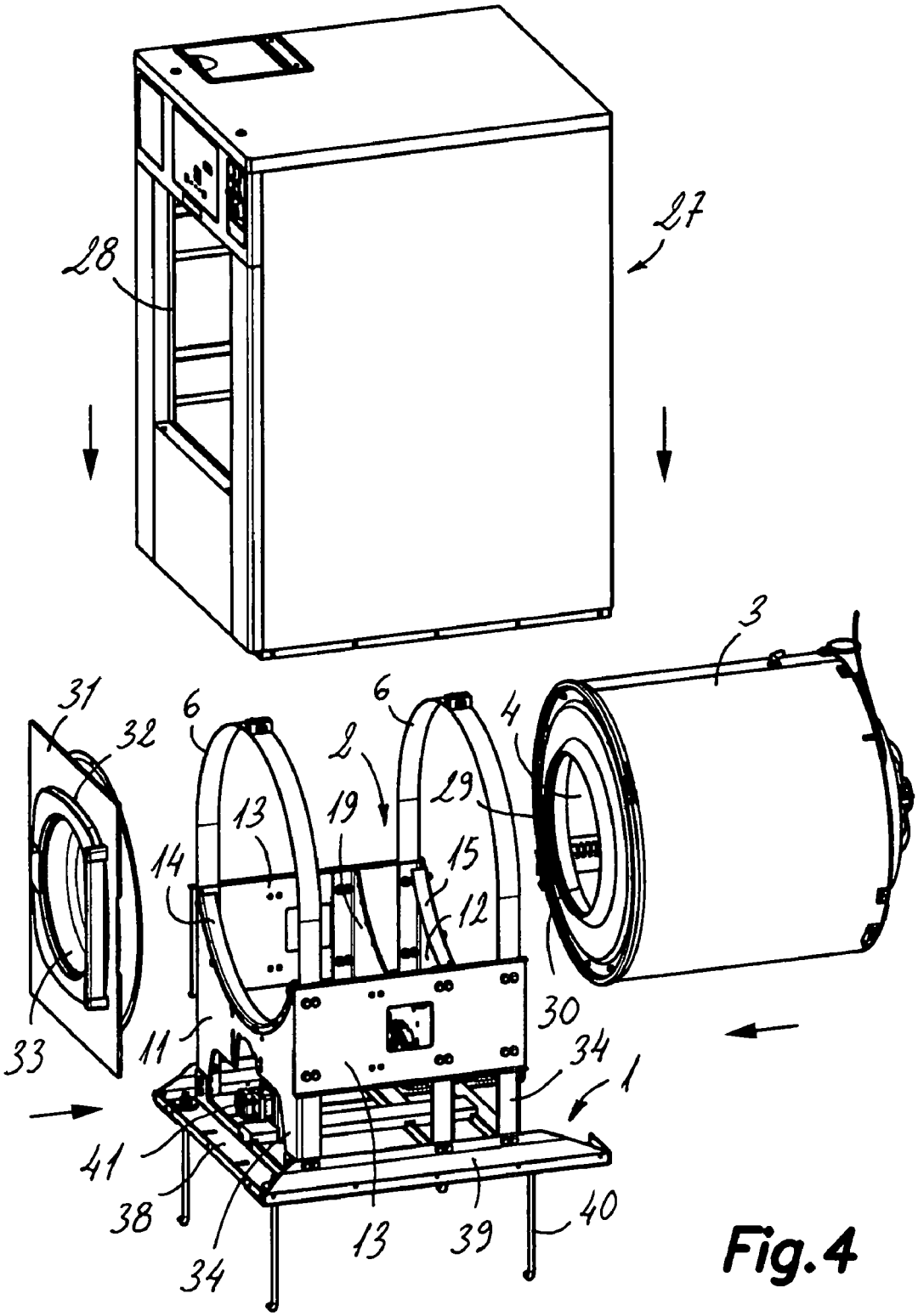
FIG. 4 is an exploded, perspective view of a clothes washing machine that incorporates a support structure according to a second embodiment of this invention.
Figure 5:
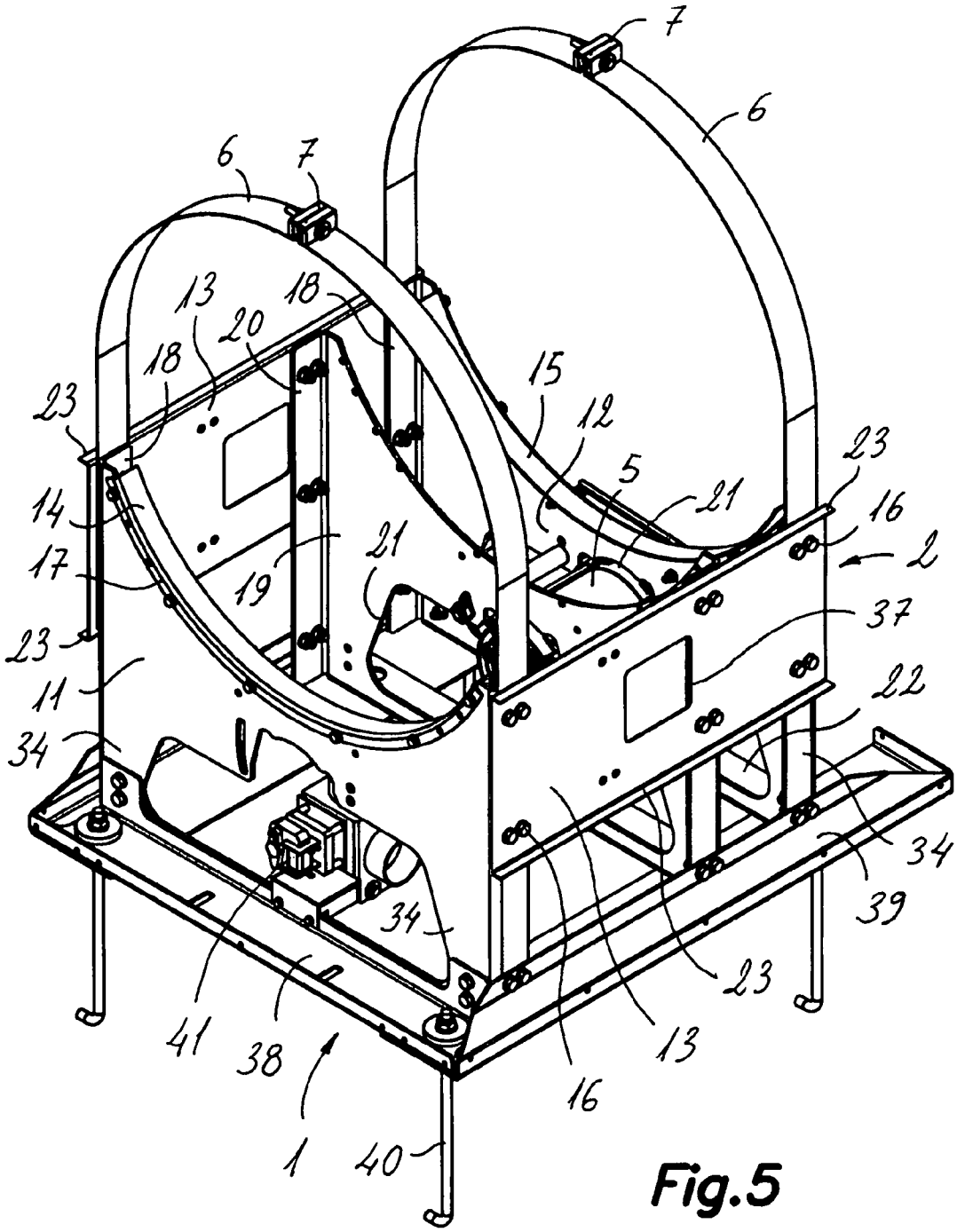
FIG. 5 is a perspective view of a base and a frame that make up the support structure of FIG. 4.
Figure 6:
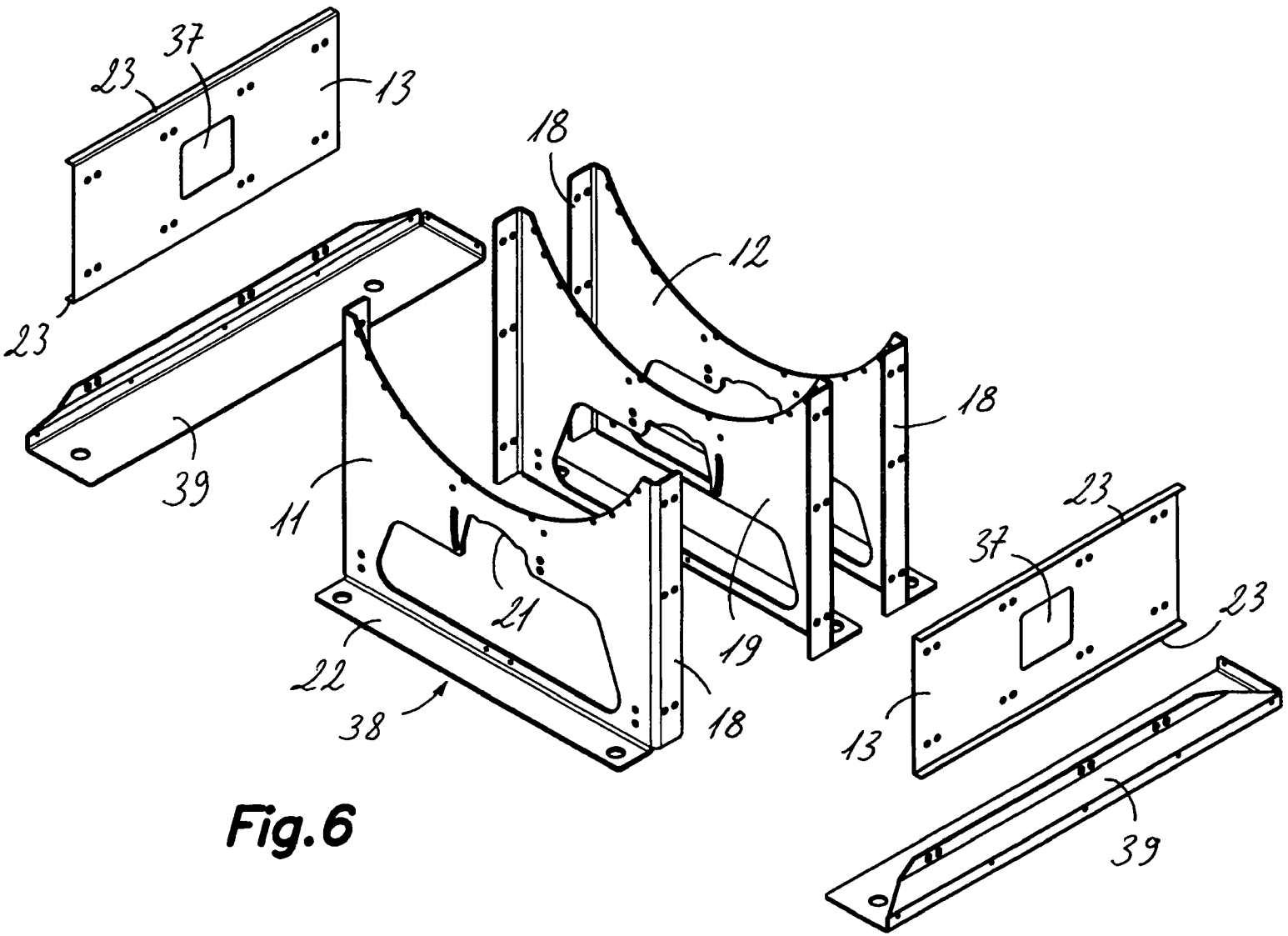
FIG. 6 is an exploded, perspective view of the frame and the base of FIGS. 4 and 5.

With reference to FIGS. 1 to 3 a support structure is described according to a first embodiment of this invention, applied to a clothes washing machine that has a suspension system, while with reference to FIGS. 4 to 6 a support structure is described according to a second embodiment of this invention applied to a clothes washing machine with a rigid structure. The characteristics that are common to both embodiments are indicated with the same reference numbers.

With reference, first of all, to the first embodiment illustrated in FIGS. 1 to 3, the support structure comprises a base 1 adapted to rest on the floor and a frame 2 provided on said base 1 and linked thereto by linking means that make up a suspension system that will be described in greater detail below. As shown best in FIG. 3, frame 2 comprises several resistant elements made up of metal plate elements shaped exclusively by cutting and folding. These plate elements are assembled and joined together by screw attachment means, such as screw and self-locking nut combinations. Alternatively, the screw attachment means can include screws passed through through-holes in one or more parts and screwed into threaded holes on the other part. However, if desired, the said screw attachment means can be replaced with deformation attachment means, or by a combination of both.

As shown best in FIG. 3, frame 2 is made up of a front plate element 11, a rear plate element 12 and a pair of said plate elements 13. The front and rear plate elements 11, 12 have flanges 18 formed at the ends thereof, folded at right angles, and arranged parallel to said side plate elements 13, and backing on to and joined to end portions thereof by screw or deformation attachment means installed through respective opposite holes. So, the front, rear and side plate elements 11, 12, 13 form a box with substantially vertical walls, substantially rectangular and with a large, open bottom wall. Obviously, the folded flanges could be formed on side plate elements 13 and joined to front and rear plate elements 11, 12 with equivalent results.

Frame 2 includes attachment means for rigidly coupling a washing tub 3 inside which a drum 4 is mounted to rotate with respect to an axis that is substantially horizontal, or slightly tilted with respect to a horizontal direction. Said attachment means have support surfaces suitable for receiving the lower area of washing tub 3, and anchoring configurations 16 for attaching tie-rods 6 arranged around an upper area of washing tub 3 and pressing it against said support surfaces. The support surfaces are cradle shape and, in their simplest form, they are defined by a curved, concave shape of upper edges of front and rear plate elements 11, 12.

Preferably, on said upper edges of front and rear plate elements 11, 12 respective front and rear 14, 15 support plate elements are provided (illustrated better in FIG. 3), each of which has an arched concave portion that defines said support surface and a flat flange 17, folded at right angles, parallel to the respective front and rear plate element 11, 12, and backing on to and linked thereto by screw or deformation attachment devices installed through respective opposite holes. To ensure that washing tub 3 does not move with respect to frame 2, between the support surfaces defined by the front and rear support plate elements 14, 15 and an outer surface of drum 4 a layer of adhesive is added, for example, a cured polyurethane adhesive. Alternatively, the support surfaces can be provided with plastic or elastomer gaskets snap attached to the cradle shape upper edges of front and rear plate elements 11, 12.

Said tie-rods 6 are in the form of bands of relatively flexible material and their ends are trapped between said flanges 18 of front and rear plate elements 11, 12 and the corresponding side plate elements 13, and include holes opposite said holes in flanges 18 and side plate elements 13. So, said screw or deformation attachment devices are installed through all the opposite holes in the three parts whereby the ends of the tie-rods remain trapped and firmly held in the frame. Said opposite holes of flanges 18 and side plate elements 13 make up said anchoring configurations 16 for the ends of tie-rods 6, although alternatively the anchoring configurations could have any other shape that could easily occur to a person skilled in the art. Advantageously, each tie-rod 6 is made up of two halves joined at the top part of washing tub 3 by a tensioning device 7.

Frame 2 also comprises an intermediate plate element 19, located between front and rear plate elements 11, 12 and parallel thereto. Similar to front and rear plate elements 11, 12, said intermediate plate element 19 has flanges 20 shaped at the ends thereof, folded at right angles, parallel to said side plate elements 13, and backing on to and joined thereto by screw or deformation attachment means installed through respective opposite holes. Rear plate element 12 and intermediate plate element 19 have respective openings 21 for installing said motor 5 and a series of holes for attaching it. The motor output axis is connected to the rotation axis of drum 4 by a pulley or chain type transmission (not shown) installed on respective pulleys or gears. Frame 2 also includes a support configuration (not shown) for supporting a drainage conduit connected to an output of washing tub 3.

Front, rear and intermediate plate elements 11, 12, 19 preferably have at least one reinforcement fold 22 (FIG. 3) in a transverse direction with respect to the direction of said axis of drum 4, and, therefore, transverse to flanges 18, 20. Also, said front, rear and intermediate plate elements 11, 12, 19 are preferably symmetrical with respect to a vertical plane that contains the axis of drum 4 and identical to one another, although at the cost of incorporating some unnecessary, repeated or redundant configurations, since the benefit of having identical, exchangeable parts, at least two of which can be mounted in different orientations, is greater than the task of forming said configurations. Similarly, side plate elements 13 have at least one reinforcement fold 23 in a longitudinal direction with respect to the direction of said axis of drum 4 and are symmetrical with respect to a vertical plane that contains a perpendicular to the axis of drum 4 and identical to one another. Preferably, side plate elements 13 are also symmetrical with respect to a horizontal plane, such as in the embodiment shown in FIGS. 4 to 6.

In the embodiment shown in FIGS. 1 to 3, reinforcement folds 23 above side plate elements 13 are turned inwards, and tie-rods 6 are passed through grooves 42 formed next to upper reinforcement folds 23 to arrange the ends of the tie-rods between flanges 18 of front and rear plate elements 11, 12 and side plate elements 13. Side plate elements 13 include wide openings 37 that provide access to the components contained inside frame 2, such as for example motor 5 and a drainage unit 41 installed in a central area of base 1, and which, generally, includes an emptying drum and a flexible conduit connected to an outlet of washing tub 3, for the maintenance thereof.

Base 1 is also made up of metallic plate elements 38, 39 shaped by cutting and folding, assembled and joined together by screw or deformation attachment devices. In the base, said plate elements 38, 39 generally define open connected configurations forming a quadrangle. Said linking means mentioned above for linking frame 2 to base 1 comprise, in this embodiment shown in FIGS. 1 to 3, compression springs 24 arranged on base 1, on top of which there rests frame 2, and dampers 25 joined in a hinged fashion at one end to base 1 and at the other end to frame 2. More particularly (see FIG. 2), in each corner of frame 2 a suspension unit is installed, made up of some of said compression springs 24 and a pair of said dampers 25 arranged to form a parallelogram hinged to base 1 and frame 2. In order to anchor the ends of dampers 25 in each pair, respective anchoring parts 35, 36 are used, also made up of metallic plate elements shaped by cutting and folding, and joined respectively to base 1 and frame 2 by screw or deformation attachment means.

In this first embodiment, frame 2 includes, at least in front plate element 11, configurations for attaching high mass elements 26, which act as counterweights, and said anchoring parts 36 for attaching the ends of dampers 25 to front plate element 11 of frame 2 are attached to said high mass elements 26.

At one axial end thereof washing tub 3 has an opening 29 opposite a loading and unloading mouth 30 of drum 4 located at an axial front end thereof. A front panel 31 is attached to said axial end of washing tub 3, which defines a circular framework 32 for said opening 29 of washing tub 3, as shown in FIG. 1. On one side of said framework 32 a door 33, with a conjugated circular configuration, is mounted in a hinged fashion to be closed hermetically against framework 32 or for being opened to provide access to the inside of drum 4 through opening 29 of tub 3 and loading and unloading mouth 30 of drum 4. Base 1 of the support structure is also adapted to support panels which, when assembled together, form an outer housing 27 that surrounds and covers frame 2 and said washing tub 3. Said outer housing 27 includes a wide window 28 that is opposite said front panel 31 joined to washing tub 3. So, through said window 28 a permanent access is provided to door 33 for accessing the inside of drum 4. As usual, the washing machine includes a security-closing device to ensure that door 33 is in a closed position with respect to framework 32.

Now with particular reference to FIG. 4 to 6 a second embodiment of this invention is described, which is applied to a washing machine with a rigid structure. As with the first embodiment, the support structure includes a base 1 and a frame 2 on which a washing tub 3 is rigidly coupled, which contains a rotary drum 4. As shown better in FIG. 6, in this second embodiment the construction of frame 2 is similar to that of frame 2 in the first embodiment, and the detailed description thereof is omitted.

The difference is in the linking means for joining frame 2 to base 1, which in this second embodiment comprise rigid connection elements joined rigidly to base 1 and frame 2. In the illustrated model, said rigid connection elements are made up of lower extensions 34 of front and rear plate elements 11, 12 of frame 2, and first plate elements 38 that make up base 1 are integral with said front and rear plate elements 11, 12 of frame 2 as configurations thereof. Said first plate elements 38 are firmly joined to second plate elements 39 that complete base 1.

Alternatively, plate elements 38, 39 of base 1 can be all those independent plate elements attached to one another, and the rigid connection elements between base 1 and frame 2 could also be independent elements, or extensions of side plate elements 13 of frame 2, or even extensions of some of plate elements 38, 39 that make up base 1. In view of the special construction of the structure according to this invention, plate elements 38, 39 of base 1 could be made up of configurations of front 11, rear 12 and/or side 13 plate elements, as an integral part thereof. At any event, the unit of base 1 and frame 2 is usually secured to the floor by anchorage elements that include bolts 40 that are partially embedded into the floor.

This second embodiment shown in FIGS. 4 to 6 is also similar to the first embodiment described in relation to FIGS. 1 to 3 in everything concerning the arrangement of an outer housing 27 (FIG. 4) and the configuration of a front panel 31, with a framework 32 and a door 33 for accessing the inside of drum 4 through an opening 29 in washing tub 3 and loading and unloading mouth 30 of drum 4, and therefore the detailed description thereof is omitted.

A person skilled in the art will be able to introduce variations and modification to the embodiments shown and described without departing from the scope of this invention as defined in the attached claims.

The invention claimed is:

1. A support structure for a clothes washing machine having a motor, a washing tub and a drum, comprising a frame comprising: attachment means for rigidly coupling the washing tub inside which there is mounted the drum arranged to rotate with respect to an axis that is substantially horizontal, or slightly tilted with respect to a horizontal direction, resistant elements comprising metallic plate elements shaped by cutting and folding, said resistant elements being assembled and joined together, said resistant elements comprising: a front plate element, a rear plate element, and a pair of side plate elements connected at the ends thereof to said front and rear plate elements to form a substantially rectangular box, at least some of said front, rear and side plate elements are formed with flanges folded at an angle and abutting onto and joined to others of said front, rear and side plate elements, at least one intermediate plate element, located between front and rear plate elements, parallel thereto, said intermediate plate element having flanges formed at the ends thereof that are folded at right angles, parallel to said side plate elements, and abutting onto and joined to side plate elements; and support means for mounting the motor for driving said drum, wherein at least said rear plate element and said intermediate plate element have respective openings for installing and attaching said motor, the plate elements having respective opposite holes through which screw or deformation attachment means are installed to join said front, rear, side and intermediate plate elements, and wherein said front, rear and intermediate plate elements are symmetrical with respect to a vertical plane that contains the axis of the drum and identical to one another.

2. A support structure according to claim 1, wherein said attachment means for rigidly coupling said washing tub to the frame comprise support surfaces formed in upper edges of the front and rear plate elements or in parts joined thereto, said support surfaces being adapted to receive a lower area of washing tub, and tie-rods arranged around an upper area of the washing tub and attached to anchoring configurations formed in the side plate elements, said tie-rods pressing the washing tub against said support surfaces.

3. A support structure according to claim 2, wherein said support surfaces for said lower area of the washing tub are cradle shape and they are defined by a curved, concave configuration of said upper edges of the front and rear plate elements.

4. A support structure according to claim 2, wherein said support surfaces for said lower area of the washing tub are cradle shape and they are defined by front and rear support plate elements, each of which has an arched, concave portion that includes the support surface and a flat flange, folded at right angles, parallel to the respective front or rear plate element, said flat flange abutting onto and being joined to an upper arched edge of the corresponding front or rear plate element by screw or deformation attachment devices, the flat flange and the front or rear plate element having respective opposite holes through which said screw or deformation attachment devices are installed.

5. A support structure according to claim 2, wherein the front and rear plate elements have flanges formed at the ends thereof, folded at right angles, parallel to said side plate elements, abutting onto and joined to the side plates by screw or deformation attachment devices, said flanges and the side plate elements having respective opposite holes through which said screw or deformation attachment devices are installed.

6. A support structure according to claim 5, wherein said tie-rods have their ends trapped between said flanges of the front and rear plate elements and the corresponding side plate elements, with said ends of tie-rods including holes opposite said holes of the flanges and side plate elements, with said screw or deformation attachment means being installed through said opposite holes of the three parts, which form said anchoring configurations.

7. A support structure according to claims 1, wherein said front, rear and intermediate plate elements have at least one reinforcement fold in a transverse direction with respect to the direction of said axis of the drum.

8. A support structure according to claim 1, wherein the side plate elements have at least one reinforcement fold in a longitudinal direction with respect to the direction of said axis of drum.

9. A support structure according to claim 8, wherein said side plate elements are symmetrical with respect to a vertical plane containing a line perpendicular to the axis of drum and identical to one another.

10. A support structure according to claim 9, wherein the side plate elements are also symmetrical with respect to a horizontal plane.

11. A support structure according to claim 1, further comprising a base adapted to rest on the floor and to support the frame, which is arranged on said base and linked thereto by linking means, wherein the base is made up of metallic plate elements shaped by cutting and folding, assembled and joined together by screw or deformation attachment devices.

12. A support structure according to claim 11, wherein said linking means for linking the frame to the base comprise compression springs arranged on the base and on top of which there rests the frame, and dampers joined in a hinged fashion at one end to the base and at the other end to the frame.

13. A support structure according to claim 12, wherein in each corner of the frame a suspension unit is installed that is made up of some of said compression springs and a pair of said dampers arranged to form an articulated parallelogram together with the base and the frame.

14. A support structure according to claim 12, wherein the frame includes configurations for attaching high mass elements, which act as counterweights.

15. A support structure according to claim 1, further comprising a base adapted to rest on the floor and to support the frame, wherein the frame is arranged on said base and joined thereto by rigid connection elements.

16. A support structure according to claim 15, wherein the base is made up of metallic plate elements shaped by cutting and folding, assembled and joined together by screw or deformation attachment devices, and said rigid connection elements for joining the frame to the base are made up of lower extensions of the front and rear plate elements or lower extensions of the side plate elements.

17. A support structure according to claim 15, wherein the base is made up of configurations of the front and rear plate elements and/or configurations of the side plate element.

18. A support structure according to claim 11, wherein said base is adapted to also support panels that, when assembled together, make up an outer housing that surrounds and covers the frame and said washing tub, said outer housing including a window opposite an opening of the washing tub which, in turn, is opposite a loading and unloading mouth of the drum which is located at one front axial end thereof, a front panel being attached to the washing tub, defining a framework for said opening of the washing tub, and a door being mounted in a hinged fashion on one side of said framework to close against it.

19. A support structure according to claim 15, wherein said base is adapted to also support panels that, when assembled together, make up an outer housing that surrounds and covers the frame and said washing tub, said outer housing including a window opposite an opening of the washing tub which, in turn, is opposite a loading and unloading mouth of the drum which is located at one front axial end thereof, a front panel being attached to the washing tub, defining a framework for said opening of the washing tub, and a door being mounted in a hinged fashion on one side of said framework to close against it.

20. A support structure for a clothes washing machine having a motor, a washing tub and a drum, comprising a frame comprising: attachment means for rigidly coupling the washing tub inside which there is mounted the drum arranged to rotate with respect to an axis that is substantially horizontal, or slightly tilted with respect to a horizontal direction, resistant elements comprising metallic plate elements shaped by cutting and folding, said resistant elements being assembled and joined together, said resistant elements comprising: a front plate element, a rear plate element, and a pair of side plate elements connected at the ends thereof to said front and rear plate elements to form a substantially rectangular box, at least some of said front, rear and side plate elements are formed with flanges folded at an angle and abutting onto and joined to others of said front, rear and side plate elements, at least one intermediate plate element, located between front and rear plate elements, parallel thereto, said intermediate plate element having flanges formed at the ends thereof that are folded at right angles, parallel to said side plate elements, and abutting onto and joined to side plate elements; and support means for mounting the motor for driving said drum, wherein at least said rear plate element and said intermediate plate element have respective openings for installing and attaching said motor, the plate elements having respective opposite holes through which screw or deformation attachment means are installed to join said front, rear, side and intermediate plate elements.

21. A support structure according to claims 20, wherein said front, rear and intermediate plate elements have at least one reinforcement fold in a transverse direction with respect to the direction of said axis of the drum.

22. A support structure according to claim 20, wherein said front, rear and intermediate plate elements are symmetrical with respect to a vertical plane that contains the axis of the drum and identical to one another.

23. A support structure according to claim 20, wherein the side plate elements have at least one reinforcement fold in a longitudinal direction with respect to the direction of said axis of drum.

24. A support structure according to claim 20, wherein said side plate elements are symmetrical with respect to a vertical plane containing a line perpendicular to the axis of drum and identical to one another.

25. A support structure according to claim 20, wherein the side plate elements are also symmetrical with respect to a horizontal plane.

* * * * *